US005581840A

United States Patent [19]

Chen

[11] Patent Number: 5,581,840

[45] Date of Patent: Dec. 10, 1996

[54] HAIRBRUSH

[76] Inventor: Li-min Chen, 7th Fl., No. 62, Yuying St., Taiping Hsiang, Taichung Hsien, Taiwan

[21] Appl. No.: 571,676

[22] Filed: Dec. 13, 1995

[51] Int. Cl.[6] ..... A46B 3/00; A46B 7/00

[52] U.S. Cl. ..... 15/187; 15/176.1; 15/176.4; 15/201; 15/202; 601/137

[58] Field of Search ..... 15/159.1, 160, 15/186–188, 176.1–176.6, 201, 202; 132/128; 601/136–139, 141, 142, 61, 62

[56] References Cited

U.S. PATENT DOCUMENTS

| | | | |
|---|---|---|---|
| 2,052,836 | 9/1936 | Löwy | 15/186 |
| 2,482,928 | 9/1949 | Neff et al. | 15/186 |
| 2,882,544 | 4/1952 | Hadidian | 15/201 |
| 3,886,619 | 6/1975 | Natman et al. | 15/187 |

FOREIGN PATENT DOCUMENTS

| | | | |
|---|---|---|---|
| 983311 | 6/1951 | France | 15/186 |
| 360209 | 9/1922 | Germany | 601/137 |
| 1635989 | 3/1991 | U.S.S.R. | 601/137 |

*Primary Examiner*—Mark Spisich
*Attorney, Agent, or Firm*—William E. Pelton

[57] ABSTRACT

A brush includes a handle, a base plate, a bristle holder, and a plurality of springs. The handle and the base plate are integrally formed. The base plate has a recessed portion defined therein, a locating channel defined around a peripheral wall of the recessed portion, and a plurality of holes defined in the recessed portion. The bristle holder carries a plurality of bristles and has a locating rim defined in a peripheral bottom thereof for engagement with the locating channel. The plurality of springs are respectively received within the plurality of holes and are compressed between an under surface of the bristle holder and peripheries defining corresponding holes to permit a reciprocating movement of the bristle holder against the springs.

3 Claims, 2 Drawing Sheets

HAIRBRUSH

FIELD OF THE INVENTION

This invention relates to a hairbrush and more particularly, to a hairbrush which is able to perform certain movement to accommodate the form of the head and meanwhile massage the head.

BACKGROUND OF THE INVENTION

Hairbrushes have been commonly used for many centuries. A conventional style of hairbrush is shown in FIG. 4. Such a hairbrush substantially comprises a base plate 30, a bristle holder 34 with a plurality of bristles 36 thereon being secured to an end 32 of the base plate 30. However, it is found that the position of the bristle holder 34 is stationary so it cannot reciprocatingly move in accordance to the form of the head and does not provide a massage for the head.

The present invention provides a hairbrush to mitigate and/or obviate the aforementioned problems.

SUMMARY OF THE INVENTION

The primary objective and advantage of the present invention is to provide a hairbrush which can reciprocatingly move along the head and massage the head.

The hairbrush includes a handle and a base plate integrally formed, the base plate including a recessed portion defined therein, a locating channel defined around a peripheral wall of the recessed portion, and a plurality of holes in the recessed portion; a bristle holder carrying a plurality of bristles, the bristle holder having a locating rim at a peripheral bottom to be received in the locating channel; and a plurality of springs received respectively within the plurality of holes, the springs being compressed between a bottom of the bristle holder and peripheries defining corresponding holes to permit a reciprocating movement of the bristle holder against the springs.

Other objects, advantages, and novel features of the invention will become more apparent from the following detailed description when taken in conjunction with the accompanying drawings.

DESCRIPTION OF THE PREFERRED EMBODIMENT

Figure 1:
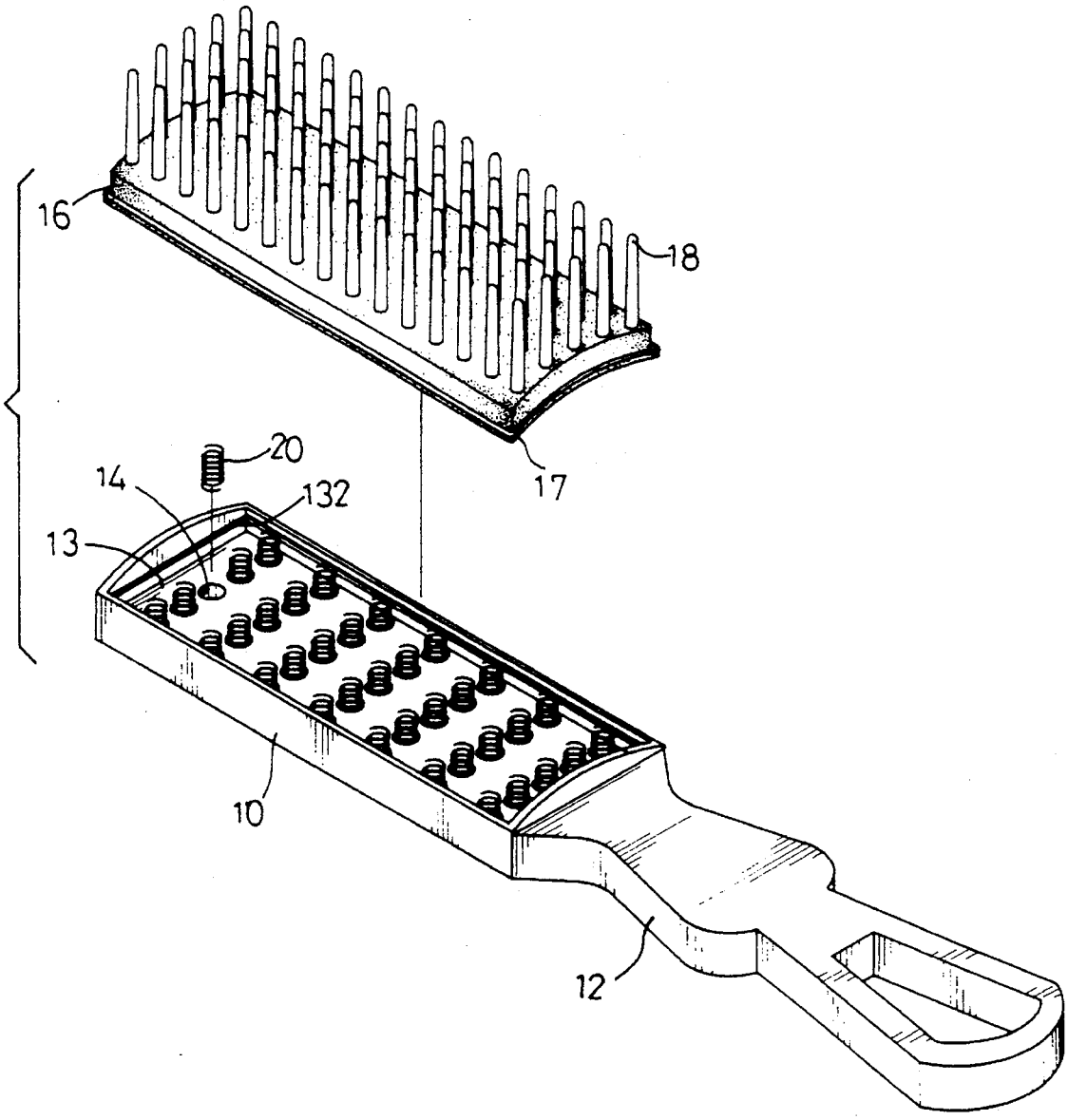
FIG. 1 is a perspective, exploded view of a comb in accordance with the present invention.
Figure 2:
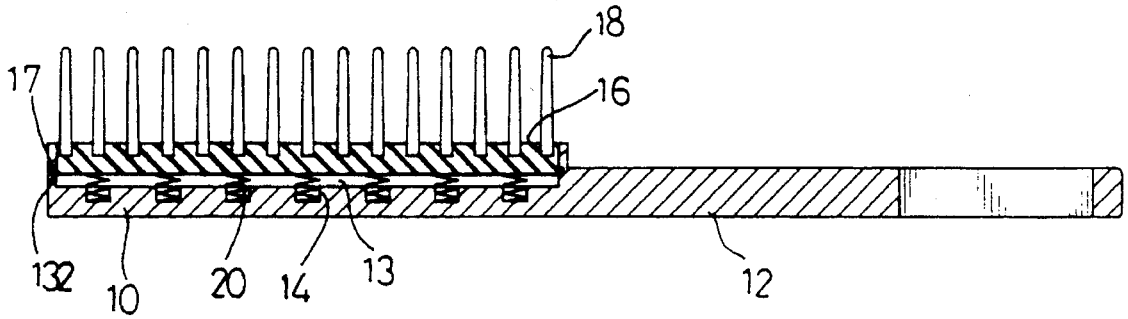
FIG. 2 is a cross-sectional side view of the comb as shown in FIG. 1.

Referring to the drawings and particularly FIGS. 1 and 2, a hairbrush includes a base plate 10 and a handle 12, a bristle holder 16 and a plurality of springs 20.

The base plate 10 has a recessed portion 13 therein. The recessed portion 13 defines a locating channel 132 around a peripheral wall thereof and further defines a plurality of holes 14 in a bottom face thereof.

The bristle holder 16 has a plurality of bristles 18 formed thereon and further has a locating rim 17 at a peripheral bottom thereof for engagement therewith, such as by engagement to the locating channel 132 by glue, so that the bristle holder 16 is secured to the base plate 10. The bristle holder 16 is made from a semi-flexible material, such as plastics or rubber.

The springs 20 are respectively received within each of the plurality of holes 14 and are compressed between an under surface of the bristle holder 16 and peripheries defining the corresponding holes 14 to permit a reciprocating movement of the bristle holder against the springs 20.

Figure 3:
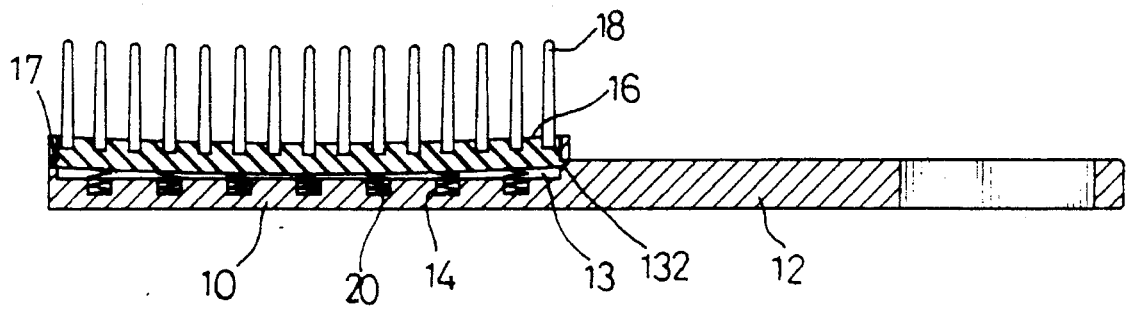
FIG. 3 is a cross-sectional side view of the comb showing a use thereof.
Figure 4:
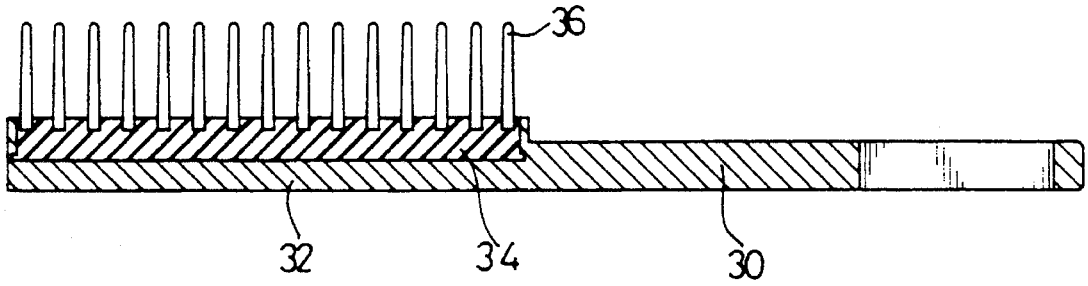
FIG.4 PRIOR ART
FIG. 4 is a cross-sectional side view of a prior art comb.

As shown in FIG. 3, when the comb is in use, the bristles 18 and bristle holder 16 are able to perform certain movement to accommodate the form of the head and meanwhile massage the head.

Those skilled in the art will recognize that variations and modifications may be made without departing from the true spirit and scope of the invention. The invention is therefore not to be limited to the illustrations and descriptions set forth but is to be determined by the appended claims.

What the invention claimed is:

1. A hairbrush comprising:

a base plate having a handle integrally formed at one end thereof, a recessed portion defined therein, a locating channel defined around a peripheral wall of the recessed portion, and a plurality of holes defined in the recessed portion;

a bristle holder carrying a plurality of bristles, the bristle holder having a locating rim at a peripheral bottom thereof for engagement with the locating channel; and a plurality of springs each having a first end respectively received within a respective one of the plurality of holes and an opposite second end adapted to contact an under surface of the bristle holder, the springs being compressed between the under surface of the bristle holder and peripheries defining corresponding holes to permit a reciprocating movement of the bristle holder against the springs.

2. The hairbrush in accordance with claim 1, wherein the bristle holder is made from a semi-flexible material.

3. The hairbrush in accordance with claim 1, wherein the bristle holder is received in the locating channel.

* * * * *